US006116252A

United States Patent [19]

Stelmach

[11] Patent Number: 6,116,252

[45] Date of Patent: Sep. 12, 2000

[54] DISPOSABLE TOOTHBRUSH WITH LANYARD

[76] Inventor: John J. Stelmach, 740 6th St., Prescott, Ariz. 86301

[21] Appl. No.: 09/344,844

[22] Filed: Jun. 28, 1999

Related U.S. Application Data

[60] Provisional application No. 60/091,591, Jul. 2, 1998.

[51] Int. Cl.[7] ..... A45D 44/18

[52] U.S. Cl. ..... 132/309; 15/167.1

[58] Field of Search ..... 132/309, 328, 132/311; 15/167.1, 227; 601/139

[56] References Cited

U.S. PATENT DOCUMENTS

| | | | |
|---|---|---|---|
| D. 290,426 | 6/1987 | Courney | 15/227 |
| 1,157,413 | 10/1915 | Nesper | 15/167.1 |
| 1,894,413 | 1/1933 | Nenning et al. . | |
| 2,915,767 | 12/1959 | Vaughan . | |
| 2,921,590 | 1/1960 | Holton . | |
| 3,105,260 | 10/1963 | Smith et al. . | |
| 3,720,975 | 3/1973 | Nelson . | |
| 4,292,705 | 10/1981 | Stouffer . | |
| 4,617,694 | 10/1986 | Bori | 15/167.1 |
| 5,097,852 | 3/1992 | Wu . | |
| 5,184,719 | 2/1993 | Gordon . | |
| 5,213,428 | 5/1993 | Salman | 15/167.1 |
| 5,287,584 | 2/1994 | Skinner | 15/167.1 |
| 5,348,153 | 9/1994 | Cole . | |
| 5,487,201 | 1/1996 | Hansen et al. | 132/309 |
| 5,647,385 | 7/1997 | Zebuhr . | |
| 5,819,765 | 10/1998 | Mittiga | 132/309 |
| 5,875,513 | 3/1999 | Reinold | 15/167.1 |

*Primary Examiner*—Todd E. Manahan
*Attorney, Agent, or Firm*—Elizabeth A. Dawn; Richard G. Harrer; Charles E. Cates

[57] ABSTRACT

A finger-mounted disposable toothbrush including a lanyard of dental floss, a first end of which is attached to the toothbrush and a second end of which is looped around the user's wrist. The dental floss lanyard prevents swallowing of the toothbrush during use and can also be used for flossing the user's teeth after brushing. The disposable toothbrush further comprises a mounting ring which fits over the user's finger. The mounting ring is affixed to the top side of a bristle base. Tooth cleaning bristles are attached to the bottom side of the bristle base and are optionally impregnated with dental paste or powder. Bumps can be molded in those areas of the bristle base and mounting ring with which the user's finger comes in contact, said bumps enhancing the user's grip on the toothbrush.

7 Claims, 1 Drawing Sheet

DISPOSABLE TOOTHBRUSH WITH LANYARD

This Non-Provisional Application claims the benefit of U.S. Provisional Application Ser. No. 60/091,591 filed on Jul. 2, 1998. This invention relates to a disposable toothbrush which is mounted on the user's finger and then secured with a lanyard of dental floss to the user's wrist to provide a means for preventing accidental swallowing of the toothbrush while brushing and for flossing the teeth after brushing.

BACKGROUND OF THE INVENTION

It is desirable to brush one's teeth after every meal. However, as many meals are not eaten at home, it is often necessary that people brush their teeth away from home. Accordingly, many people find themselves carrying a wet toothbrush in their purse or trying to fit a standard size toothbrush in a carrying case inside their pockets. This makes brushing one's teeth away from home inconvenient. Disposable tooth brushes, which must be inexpensive enough to encourage people to buy them and discard them after brushing, have been proposed to solve this problem. Various designs are known in the art, including disposable toothbrushes made to attach to a finger. These disposable toothbrushes enjoy an advantage over others because the absence of a handle makes the toothbrush more compact and easier for a person to carry, for a store to stock, or a vending machine to vend. For example, it is known to insert tooth cleaning bristles in the end portion of a paper, fabric, or elastic finger cot or sheath. U.S. Pat. Nos. 5,348,153 and 1,894,413 teach disposable toothbrushes of this type. A finger-mounted toothbrush affixed to the finger using a strip of adhesive tape is also known in the art. U.S. Pat. Nos. 2,921,590 and 2,915,767 teach inventions of this design. Also known in the art are tooth cleaning bristles mounted on bases attached to finger rings. See U.S. Pat. Nos. 3,105,260 and 3,720,975. Each of the these finger mounted toothbrushes suffer from a common problem. That is, they can slide off the finger, which may cause the user to choke, gag, or even swallow the toothbrush.

SUMMARY OF THE INVENTION

The toothbrush of the present invention overcomes the above-mentioned problem by providing a lanyard of dental floss, a first end of which is attached to the toothbrush and a second end of which is looped around the user's wrist, thus securing the toothbrush to the user's hand and thereby preventing swallowing of the toothbrush. The lanyard of dental floss creates the additional benefit of providing a convenient source of dental floss for the user of the present invention. Thus, the lanyard not only prevents swallowing, but also promotes dental hygiene.

It is an object of this invention to provide a compact, finger-manipulated toothbrush.

It is another object of this invention to provide an inexpensive toothbrush that can be disposed of after a single use.

It is another object of this invention to provide a disposable toothbrush with bristles optionally impregnated with a dental paste or powder.

It is another object of this invention to provide a disposable toothbrush with a lanyard of dental floss affixed thereto which is structured to be secured to the user's hand to prevent swallowing of the toothbrush, and which provides a convenient source of dental floss for flossing the user's teeth.

Other objects of the invention will become apparent hereinafter.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE DRAWINGS

Figure 1:
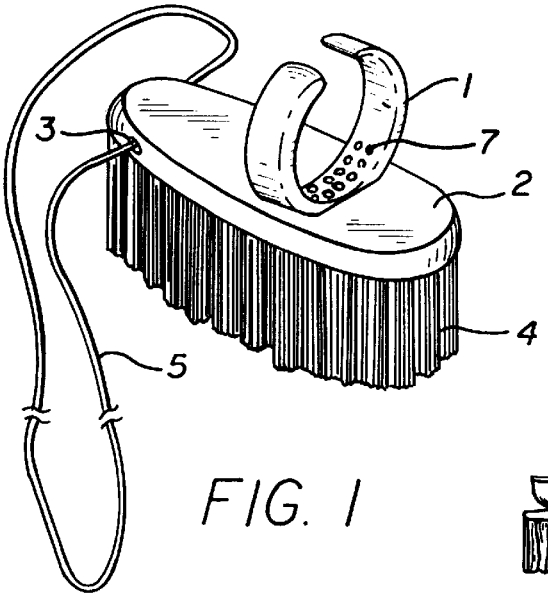
FIG. 1 is a perspective view of the disposable toothbrush showing the mounting ring 1, bristle base 2, tooth cleaning bristles 4, passage 3 and the dental floss lanyard 5.

As shown in FIG. 1, the toothbrush of the present invention comprises a mounting ring 1. The shape of mounting ring 1 and the material from which it is made enable mounting ring 1 to be fitted to a variety of finger sizes. At the uppermost point of mounting ring, a space of variable size is optionally left between the two halves of the mounting ring, allowing for even greater flexibility in the finger size that the mounting ring can accommodate.

Figure 3:
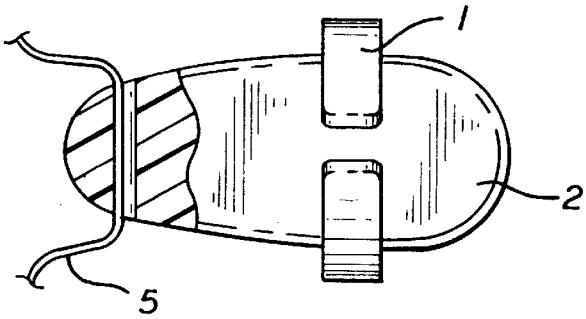
FIG. 3 is a top view of the disposable toothbrush showing the adjustable mounting ring 1 and the dental floss lanyard 5.

In a preferred embodiment of the invention shown in FIGS. 1 and 3, mounting ring 1 and bristle base 2 are made of a polyethylene plastic material, but other materials will be known to persons skilled in the art.

As shown best in FIGS. 1 and 3, mounting ring 1 is affixed to the top surface of bristle base 2. Preferably, mounting ring 1 and bristle base 2 are molded as one piece so that the surface of mounting ring is continuous with the top surface of bristle base. In the preferred method of manufacture, the mounting ring 1 and bristle base 2 are molded as one piece of polyethylene or other plastic or rubber material. Bumps 7, shown in FIG. 1, can be molded with the mounting ring and bristle base. Bumps 7 function to enhance the user's grip on the toothbrush.

Tooth cleaning bristles 4 are fixed in the bottom surface of bristle base 2. In a preferred embodiment of the invention, tooth cleaning bristles 4 are made of a polyethylene plastic material. As a final step in the manufacture of the disposable toothbrush, the tooth cleaning bristles 4 are optionally impregnated with a dental paste or powder.

Figure 2:
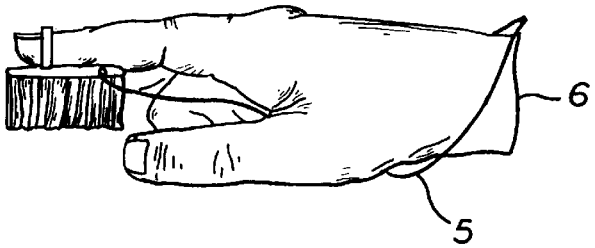
FIG. 2 is a side elevational view of the disposable toothbrush of the present invention showing the toothbrush mounted on the user's index finger and secured to the user's wrist by means of the dental floss lanyard.

As shown in FIGS. 1, 2 and 3, a dental floss lanyard 5 is inserted through the passage 3. As shown in FIG. 2, the lanyard 5 is a loop of sufficient length to be fitted around the user's wrist 6 and used for flossing after brushing, but sufficiently short to secure the toothbrush to the user's hand and prevent the swallowing of the toothbrush. The diameter of the dental floss should be such as to provide sufficient strength for flossing. Waxed dental floss is preferred, but other types of dental floss can also be used with the present invention.

Figure 4:
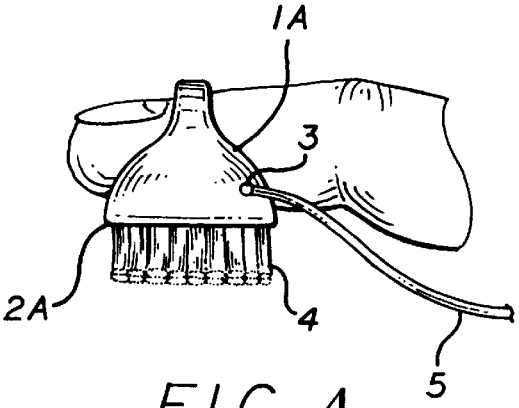
FIG. 4 is a side elevational view of an alternative embodiment of the present invention wherein the bristle base forms a continuous curve with the mounting ring. This Figure shows the mounting ring 1 extending across the entire width of bristle base 2; however, the mounting ring can be formed to any desired width.
Figure 5:
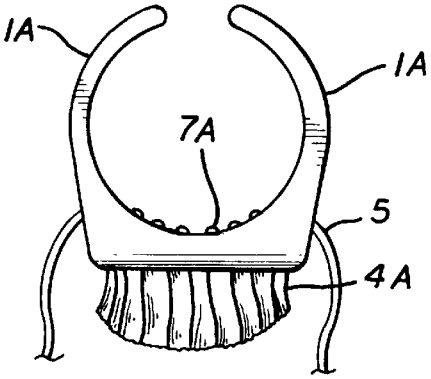
FIG. 5 shows an alternative embodiment of the present invention wherein the bristle base forms a continuous curve with the mounting ring. Bumps 7 molded on that portion of the bristle base and mounting ring with which the user's finger comes in contact facilitate the user's grip on the toothbrush.

FIGS. 4 and 5 show another embodiment of the disposable toothbrush of the present invention wherein bristle base 2A is concave to fit the contour of a user's finger. In this embodiment, the mold can then be fashioned so that mounting ring 1A extends outward and upward from either side of bristle base 2A. This embodiment of the invention has the advantage of producing a disposable toothbrush with a profile lower than a flat bristle base. FIG. 4 and FIG. 5 show the embodiment of the invention where the bristle base is curved. Additionally, bumps 7A, as shown in FIG. 5, can be added to the finger side of the bristle base, enhancing the user's grip on the toothbrush.

To use the invention, lanyard 5 is fitted around the user's wrist. The user's finger is then inserted in mounting ring 1. Dental powder or paste is either added or already present in the tooth cleaning bristles 4. After brushing, the dental floss lanyard 5 is used to floss the teeth. After brushing/flossing, the entire apparatus may be discarded.

I claim:

1. A toothbrush including:

a. a bristle base having a first side with tooth cleaning bristles and a second side provided with means for engaging the user's finger;

b. a passage transversely formed in said base; and c. a length of floss inserted through said passage and joined so as to form a lanyard to be worn about the user's wrist during brushing.

2. The toothbrush of claim 1 wherein grip enhancing bumps are provided on said toothbrush at the point of contact between the user's finger and said toothbrush.

3. The toothbrush of claim 1 wherein said tooth cleaning bristles are impregnated with a dental cleaning agent.

4. The toothbrush of claim 1 wherein said means for engaging the user's finger is an adjustable ring mounted to said bristle base.

5. The toothbrush of claim 1 wherein said bristle base is concave on said second side.

6. The toothbrush of claim 5 wherein said means for engaging the user's finger is a ring means which is continuous with the sides of said bristle base.

7. The toothbrush of claim 6 wherein a variable space is provided in the ring at a point opposite said bristle base enabling said ring to receive a variety of finger sizes.

* * * * *